US006051047A

United States Patent [19]

Zhou et al.

[11] Patent Number: 6,051,047

[45] Date of Patent: Apr. 18, 2000

[54] CO-PRECIPITATION-REDUCTION-DIFFUSION PROCESS FOR THE PREPARATION OF NEODYMIUM-IRON-BORON PERMANENT MAGNETIC ALLOYS

[75] Inventors: Yongqia Zhou; Xuying Hu; Panwen Shen; Shoumin Zhang, all of Tianjin, China

[73] Assignees: Nankai University; Tianjin Kenda Industry & Trade Group Company, both of Tianjin, China

[21] Appl. No.: 09/007,834

[22] Filed: Jan. 15, 1998

[30] Foreign Application Priority Data

May 22, 1997 [CN] China ..... 97104333

[51] Int. Cl.[7] ..... B22F 9/24; H01F 1/08

[52] U.S. Cl. ..... 75/349; 75/350; 148/105

[58] Field of Search ..... 75/348, 349, 350; 148/105

[56] References Cited

U.S. PATENT DOCUMENTS

| | | | |
|---|---|---|---|
| 4,037,825 | 7/1977 | Burgert | 259/95 |
| 4,314,090 | 2/1982 | Shewbart et al. | 585/328 |
| 4,380,684 | 4/1983 | Fowler et al. | 585/328 |
| 4,538,018 | 8/1985 | Carter | 585/212 |
| 4,917,724 | 4/1990 | Sharma | 75/350 |
| 5,403,942 | 4/1995 | Becker et al. | 556/175 |
| 5,482,572 | 1/1996 | Eggert et al. | 148/101 |
| 5,735,969 | 4/1998 | Lown et al. | 75/348 |

FOREIGN PATENT DOCUMENTS

| | | |
|---|---|---|
| 0 386747 A2 | 9/1990 | European Pat. Off. . |
| 0 386747 A3 | 9/1991 | European Pat. Off. . |
| 9-129423 | 5/1997 | Japan . |

*Primary Examiner*—George Wyszomierski

*Attorney, Agent, or Firm*—Burns, Doane, Swecker & Mathis LLP

[57] ABSTRACT

The present invention relates to the preparation of Nd—Fe—B permanent magnetic alloys and more particularly to a process of preparing Nd—Fe—B permanent magnetic alloys with neodymium, iron and boron as their basic constituents, wherein ammonium hydroxide (concentrated ammonia water) and ammonium carbonate are used as the precipitant, and neodymium salts, ferrous salts and soluble boron compounds as the starting materials for alloy elements such as neodymium, iron and boron, in addition, machining surplus or wastes of Nd—Fe—B alloys can also be used as raw materials so as to avoid the use of expensive rare earth metal. The process of the present invention comprises the steps of co-precipitation, hydrogen pre-reduction, calcium reduction-diffusion, rinsing, drying and powder manufacturing etc. and is capable of significantly reducing the costs compared with any of the existing processes. The invention has the ability to directly introduce non-metallic element boron into the alloys, to solve the problem concerning solid-phase side-reactions during hydrogen pre-reduction, and to avoid neodymium run-off and oxidation of alloy elements during rinsing procedure so as to ensure the rinsing cleanliness, whereby alloys are obtained with purity above 99% and calcium content of 0.01–0.05 wt %.

23 Claims, No Drawings

CO-PRECIPITATION-REDUCTION-DIFFUSION PROCESS FOR THE PREPARATION OF NEODYMIUM-IRON-BORON PERMANENT MAGNETIC ALLOYS

FIELD OF THE INVENTION

The present invention relates to the preparation of a neodymium-iron-boron (referred to as Nd—Fe—B in this description) permanent magnetic alloys and more particularly to a process of preparing Nd—Fe—B Permanent magnetic alloys by using a wet-process steps of a co-precipitation and intermediate products and Nd—Fe—B permanent magnetic alloys prepared by the process.

DESCRIPTION OF THE PRIOR ART

The prior art preparation technology covers three categories, known as the rapid quenching process (Croat et al., Appl. Phys. Lett. 44(1) (1984) 148), the powder metallurgical process (Sagawa et al., J. Appl. Phys. 55(6) (1984) 2083) and various modification techniques thereof, and the calcium reduction-diffusion process ("Proc. 8th Int. Workshop on RE Magnets and Their Application", 407 (1985)). All of these are dry processes in metallurgy. A common problem with dry processes is the requirement of starting materials of very high purity. Moreover, any wastes, whenever occur, or machining surplus produced during cutting the sinters into magnetic elements, normally making up 30–50%, even more of the sinters weight, may not be used directly, at most may be used for recovering rare earths therefrom. Therefore, the cost for this kind of processes can hardly be further reduced.

The present invention is understood to provide a pioneer invention of process incorporating wet-process steps into the preparation of Nd—Fe—B permanent magnetic alloys. This process can significantly reduce the cost compared to any of the prior art processes, because soluble rare earth salts are used as the starting materials so as to avoid the use of expensive rare earth metals, because purity of the starting materials is allowed to be as low as 98%, even less, because the machining surplus or wastes in Nd—Fe—B processing may be used directly as parts of the starting materials, and because the Nd—Fe—B alloys thus obtained are already in the form of powders of 10–50 microns in diameter so as to greatly save the energy consumption in powder manufacturing.

Thus, a object of the present invention is to provide a process for the preparation of Nd—Fe—B permanent magnetic alloys (the so-called third generation of rare earth permanent magnetic alloys) by co-precipitation-reduction-diffusion method. In the present invention, the alloy elements are allowed to enter from aqueous solution to co-precipitate in a given proportion, the co-precipitate is then converted to hydrogen pre-reduction products containing only alloy elements and oxygen, and finally the Nd—Fe—B magnetic alloys are obtained by the calcium reduction-diffusion method, composed mainly of 28.0–50.0 wt % of neodymium and 0.6–2.8 wt % of boron with the remainder being principally iron. An another object of the present invention is to provide the intermediate products (coprecipitate products and hydrogen pre-reduction products) and Nd—Fe—B permanent magnetic alloys prepared by the process.

In comparison with existing technology, the main features of the invention lie in that the following problems were solved: introducing non-metallic element boron into the co-precipitate and alloy, dispelling the effect from solid-phase side-reaction in hydrogen pre-reduction, and avoiding neodymium ran-off and alloy-oxidation during the rinsing procedure while ensuring the rinsing cleanliness.

SUMMARY OF THE INVENTION

The present invention mainly comprises a process for the preparation of Nd—Fe—B permanent magnetic alloys, comprising the steps of:

(a). mixing an aqueous solution of a neodymium salt with an aqueous solution of a ferrous salt to yield a feed solution, which is then subjected a co-precipitation with a precipitant of an aqueous solution of ammonium hydroxide and ammonium carbonate containing a soluble boron compound to form a co-precipitate product;

(b). introducing hydrogen into the co-precipitate product to remove part of oxygen therefrom, with the hydrogen pre-reduction continuing until there is no moisture evolving in the tail gas and only oxygen is left over in the product apart from the alloy elements, so as to form a hydrogen pre-reduction product;

(c). completely mixing the hydrogen pre-reduction product with at least one of metallic calcium and calcium hydride, to cause a calcium reduction-diffusion; and (d). rinsing, drying the reduction product, and manufacturing the alloy powders.

DETAIL DESCRIPTION OF THE INVENTION

Nd—Fe—B alloys are prepared by mixing a neodymium salt and a ferrous salt to yield a feed solution, using the feed solution to conduct co-precipitation along with an aqueous solution of ammonium hydroxide (concentrated ammonia water) and ammonium carbonate containing a soluble boron compound, after complete reaction, setting the solution aside, followed by filtering, water washing and drying; grinding the co-precipitation product, and heating it in a rotary drying furnace under nitrogen to eliminate ammonia, then introducing hydrogen to remove part of oxygen so as to leave oxygen alone in the product apart from alloy elements, subsequently cooling the product and rinsing it with water in a conical rinser; after drying, placing the pre-reduction product in a sealed reaction can under an inert or reducing atmosphere or under vacuum to perform further reduction by metallic calcium or calcium hydride at a high temperature; then soaking the reduction product with water, milling and rinsing it with water and chemicals in a conical rinser under an inert gas, then soaking it with volatile organic solvents, and finally drying at 120° C. under vacuum and milling it.

By adjusting the composition of co-precipitate in the present process, namely that light rare earths such as lanthanum, cerium, praseodymium etc., or heavy rare earths such as terbium, dysprosium, holmium etc. may be used to replace part of neodymium, aluminum to replace part of boron, and transition metals such as cobalt, nickel, copper, niobium etc. to replace part of iron, we can obtain permanent magnetic alloys with improved or modified magnetism. In the co-precipitation step, water soluble neodymium salts such as neodymium chloride, neodymium nitrate, neodymium sulfate etc. and salts of other rare earths, neodymium oxide and other rare earth oxides soluble in hydrochloric acid, water-soluble ferrous salts such as ferrous chloride, ferrous sulfate etc. and water-soluble salts of other transition metals, soluble boron compounds such as boric acid, borax, boron oxide etc. and soluble aluminum salts may be used as the raw materials to provide alloy elements such as neodymium, iron and boron, as well as partial substitution elements thereof.

In the process of this invention, the composition of alloy elements in the co-precipitate is predetermined, thereby the weight ratio of alloy element compounds to be used, based on alloy elements, is neodymium (per se or further including partial other rare earths):iron (per se or further including partial other transition metals):boron (per se or further including partial aluminum)=1:1.0–2.5:10–100; the amount of precipitant is 1.5–5 times of that required stoichiometrically, and the molar ratio of ammonium hydroxide to ammonium carbonate in precipitant is 1:1.5–7, more preferably 1:3–5; the amount of calcium (or calcium hydride) used is 1.4–4.0 times of the stoichiometric amount (moles) required to reduce hydrogen pre-reduction product and to convert oxygen therein to calcium oxide.

Various steps stated previously will now be described in more detail.

1. Co-precipitation

By co-precipitation it is meant that alloy elements are transferred from aqueous solution into precipitate in accordance with the predefined composition, and co-precipitate also refers to the precipitate obtained by this operation. The co-precipitation-reduction-diffusion (CPRD) method requires that the co-precipitate composition, in particular the alloy element composition therein, can be adjusted and controlled within a reasonable range, and after decomposition, normally after hydrogen pre-reduction, there exists oxygen in the resulting product as the only non-alloy element apart from alloy elements. In that case, there are actually only three kinds of compounds available as the precipitants, that is, hydroxyl, carbonate and oxalate radicals. All these three precipitants will form sparingly soluble compounds having very small solubility product with both neodymium and iron, in contrast, borates probably formed with these precipitants should be considered as soluble. Accordingly, it is difficult to introduce boron into the co-precipitate. In this invention, a mixture of ammonium hydroxide (concentrated ammonia water) and ammonium carbonate mixed in a proper proportion are chosen as the precipitant in order that in the presence of ammonium salts, neodymium, iron and boron can be introduced into the co-precipitate according to the composition requirement of Nd—Fe—B permanent magnetic alloys, wherein the molar ratio of ammonium hydroxide (concentrated ammonia water) to ammonium carbonate in the precipitant may vary from 1:7 to 10:1, typically the molar ratio of ammonium carbonate to ammonium hydroxide (concentrated ammonia water) is 1.5:1–7:1, preferably 3:1–5:1. The pH value after the feed solution has mixed with the precipitant is preferably controlled within the range of 7–10, more preferably 7–8. since solubility of the salts formed by boric acid with neodymium or iron is not very high, it is preferred to add boric acid or soluble borates to be used as raw material into the precipitant beforehand, while iron, neodymium and other metals to be added into the alloys are used in the form of soluble salts to give a feed solution, and both solutions are mixed together in an appropriate way to perform the co-precipitation. The amount of precipitant should be in excess, preferably 1.5–5 times in excess of the stoichiometric quantity. By performing the co-precipitation in the above manner, the recovery rate of neodymium and other rare earths is a maximum (not less than 95%). In preparation of the feed solution containing metal ions of the alloy elements, iron and such metal ions that can not form complexes with ammonia should be 2–10% in excess, while metal ions that can form complexes with ammonia should be 10–40% in excess, and certain ions such as copper about 1 time in excess, and boron 10–100 times in excess. There are small amount of metal ions and large amount of borate radicals in the mother liquor after filtering the co-precipitate. Two schemes may be used for recovery. One scheme is by properly acidifying the resulting solution first (decomposing large quantity of carbonate radicals), and then passing it through a column of cation ion exchange resin for recovery of the metal ions thereof. In this case, metal ions are recovered for reuse by elution with hydrochloric acid, while effluents may be directly used for preparing the precipitant solution after being properly concentrated and replenishing a required amount of boron. Another scheme is by properly acidifying and recovering metal ions, then adjusting pH to weakly alkaline (about pH 8) and passing the solution through an anion ion exchange column with chloride ions on, from which boric radicals are eluted by a weakly acidic solution (pH 4–6). The total availability of neodymium, iron and various metal ions is higher than 95%, and that of boron is not less than 90%.

One of the advantages of the process described in the present invention is that any wastes, whenever occur, or machining surplus produced in the course of cutting Nd—Fe—B sinters into magnetic elements or finishing the magnetic elements obtained, may all be dissolved with hydrochloric acid and thus used directly as the feed solution. In this case, small amount of boron present in the feed solution does not affect the co-precipitation at all, but the remaining large amount of boron needed to be made up should still be added into the precipitant. If desired, a required amount of metal salts may be added into the feed solution. In the co-precipitation of the present invention, there may be three addition fashions: sequentially adding i.e. adding the precipitant into the feed solution, anti-sequentially adding i.e. adding the feed solution into the precipitant, and adding both solutions simultaneously into the reactor at certain feed rates. The anti-sequentially-adding and simultaneously-adding fashions are preferred, especially by the anti-sequentially-adding fashion the reaction would be more smooth and uniform. The feed-rate should not be too fast. An appropriate feed-rate should allow ferrous ions to be in a prescribed pH environment in time for entering the precipitate, but not in an environment with pH value having decreased to form ferro-ammonium ions. It deserves a special caution in particular when adding metal elements which can form complexes with ammonia. Proper heating is needed for the reaction with the preferred temperature being 40–80° C., more preferably 50–60° C. After reaction the co-precipitate should undergo aging for 12–48 hours, more preferably 12–24 hours. The co-precipitate is then filtered, water washed 3–6 times and dried for subsequent use.

2. Hydrogen pre-reduction

The hydrogen pre-reduction involves two consecutive steps. In the first step, the co-precipitate undergoes initial thermal decomposition in a nitrogen stream at a temperature of 600–1000° C., the completion criterion of which is the absence of ammonia in the tail gas. In the second step, iron (and other constituents reducible by hydrogen) in the co-precipitate is reduced to its simple substance in a hydrogen stream at a temperature of 600–1000° C., and the co-precipitate is thus decomposed completely, the completion criterion of which is the fact that there is no any moisture in the tail gas. The small amount of light impurities resulting from the hydrogen pre-reduction should be removed by water rinsing. The co-precipitate should undergo grinding and sieving by the 80–180-mesh screens, typically through 100-mesh screen prior to hydrogen pre-reduction, and after hydrogen pre-reduction but prior to water rinsing, as well as after rinsing. The product of hydrogen pre-reduction should be dried completely. The content of alloy elements is not less than 87 wt %.

3. Calcium reduction-diffusion

At least one species of metallic calcium (grains or scraps) and calcium hydride is used as the reducing agent in calcium reduction. Its amount is 1.4–4.0 times of the stoichiometric amount (by moles) requires to reduce oxides contained in the product of hydrogen pre-reduction and form calcium oxide. It is necessary to mix the product of hydrogen pre-reduction with the reducing agent intimately. Reduction is carried out in a closed reaction can, in which the furnace materials are intimately packed, under an atmosphere of inert or reducing gases, or under vacuum (1–5 Pa); the reduction continues for 1–3 hours at a temperature of 1000–1250° C. When the temperature arrives at a level for the reduction to take place, the temperature is preferably under program control, that is to keep at 800–900° C. for 1–2 hours. After completion of the reduction, temperature decrease is preferably also under program control, typically to keep the temperature at 900–1100° C. for 1–3 hours for alloying, and to decrease the temperature as rapidly as possible while it has been lower than 900° C.

4. Rinsing

The rinsing procedure in the prior art using calcium reduction method for the preparation of Nd—Fe—B permanent magnetic alloys is characterized by its violent reaction, large losses of neodymium in solution and ease of oxidation of alloy fines, because acidic rinsing liquid (for example acetic acid) is usually used and the oxidized film resulting from oxidation of alloy fines in the rinsing procedure is hardly removed. In the present invention, the resulting product is rinsed by water and then by chemicals, that is, rinsed by using a basic EDTA or acetylacetone aqueous solution, after it has been soaked in water to swell up and the alloy grains have subsequently been ground to 10–50-$\mu$m-diameter, so the oxidized film freshly formed at the surface of alloy particles or the residual neodymium oxide which has not been reduced can be cleaned and removed. Chemical rinsing takes place in a basic condition, with pH value of the rinsing liquid being adjusted to 8–10 by sodium hydroxide, the EDTA concentration in rinsing liquid being 0.5–3 wt % or acetylacetone concentration at 0.5–1 vol %. Finally the product is washed with water. The effect of water-washing and that after chemical rinsing is determined by monitoring the pH value of the waste liquor. When the pH value of the waste liquor reaches and stays at 8 for at least 10 minutes, the rinsing step is over. During water washing and chemical rinsing alloy particles tend to aggregate together due to their magnetism, therefore fully agitating is necessary. All rinsing steps are performed under an atmosphere of inert or reducing gases in a conical vessel, the cross-section of which is tapered downwards, so the velocity of water stream decreases gradually as flowing upwards. As long as the flow rate is properly controlled, the overflow effluent will not entrain particles of alloy or alloy components which are not sufficiently alloyed, while all soluble or insoluble impurities which need be rinsed off, are entrained out. After thoroughly rinsing alloy fines are collected in the conical vessel for subsequent treatment. After squeezing the water out of the rinsed alloy powder, alloy powder is soaked with alcohol, acetone and ether successively, at least using one solvent from ethanol and acetone to displace the residual water from the crevices in alloy particles by volatile organic solvents in order not to leave any liquids within the crevices after drying. During displacement with organic solvents the material is preferably protected by a reducing or inert atmosphere. After the displacement with organic solvents the alloy powders are dried under vacuum condition at a temperature not higher than 120° C.

Purity of the alloy powders resulting from the previous rinsing steps may be as high as 99.0–100% in terms of the content of alloy elements, with the content of calcium being less than 0.01–0.05%. The waste liquor from rinsing steps is then treated for recovery of neodymium and other rare earths.

5. Drying and powder manufacturing

After drying at 120° C., Nd—Fe—B alloy powder obtained by the previous steps may be directly milled to a mean diameter of 3 $\mu$m, for example, by a jet mill or a wet mill process to further grind them.

The benefits of the present invention are evident. The present invention provides a method to directly introduce non-metallic element boron into the alloys and overcome the problem caused by solid-phase side-reactions during hydrogen pre-reduction, and to avoid neodymium run-off and alloy oxidation during the rinsing step, so as to ensure the rinsing cleanliness and greatly enhance the purity of the resulting Nd—Fe—B alloy. Because soluble rare earth salt is used as the starting material to eliminate the need of expensive rare earth metals; because the purity of the feed stock can be as low as 98%, or even less to allow to use machining surplus or wastes as parts of feed-stocks; and because Nd—Fe—B alloy powders are directly obtained to greatly save energy consumption for alloy grinding, the present invention can significantly decrease the cost in comparison with any of the existing processes.

The prominent substantive features and notable progress of the present invention will be embodied in the following examples, but it should be clearly understood that this illustration is made only by way of example and not regarded as a limitation of the scope of the invention.

EXAMPLE

Example 1

80 g of $NdCl_3.6H_2O$ were weighed and dissolved in 5 L of water, into which 4 ml of 1:1 hydrochloric acid were added, the solution was then gently warmed to yield a pale purple clear solution, and then 700 g of $FeCl_2.4H_2O$ were weighed and added into the above solution and dissolved, thus the feed solution was prepared. 550 g of boric acid were weighed and dissolved in 5 L of water, into which 150 ml of concentrated ammonia water were added and then 1000 g of ammonium carbonate added and dissolved, thus a clear solution was formed as a precipitant. The precipitant solution was transferred into a 20 L reactor, heated to 50–60° C., the feed solution was then slowly introduced under constant stirring (agitation speed 1500–2000 rpm) within about 30 minutes, with the pH being 7.6 after addition. The solution was allowed to stand overnight for aging, then filtered, water washed 5 times, and after drying 439 g of co-precipitate were obtained. The composition of alloy elements in the co-precipitate was $Nd_{18.2}Fe_{73.4}B_{8.4}$, and the content of alloy elements was 65.20%. The recovery rates of neodymium, iron and boron were 98.7%, 87.7% and 4%, respectively.

Example 2

The co-precipitate obtained from Example 1 was dried, ground and sieved through 100-mesh screen, then heated to 800° C. in a rotary drying furnace, and nitrogen was admitted at a flow rate of about 1 l/min. After about 1.5 hr no ammonia had been detected in the tail gas, hydrogen was then switched to enter with a flow rate of 2 l/min first, and 1 hr later it was decreased to 1 l/min. After about 2 hr in total had elapsed no moisture could be detected in the tail gas. The product was cooled and withdrawn from the furnace, crushed to sieve through 180-mesh screen, and then rinsed by an upwardly flowing water stream in a conical rinser. The flow velocity was adjusted so that there existed no black powders in the overflow liquor. Rinsing finished up within about 5 min, indicated by a sign that there was no white waxy solids in the overflow liquor. The hydrogen pre-reduction product thus rinsed was dried again in the rotary drying furnace at 120° C. under vacuum of about 5 Pa. After about 2 hr drying, the product was cooled and removed in the form of black powders, weighed about 329 g, the alloy element content of which was 88.5%. The product was pulverized, sieved by 180-mesh screen, and then mixed with 160 g of calcium scraps (about 50% in excess). The mixture was packed tightly in an iron reaction can, which was then sealed and placed in the constant temperature zone of a tubular furnace. Then the reaction mixture was subjected to a reduction-diffusion under the protection of a still argon atmosphere and by a heating sequence programmed as at 850° C. for 2 hr, at 1200° C. for 3 hr and then at 1100° C. for 2 hr. After complete reaction, the reaction can was cooled rapidly to room temperature, then opened, and the product was soaked in water. When hydrogen stopped escaping, the material which had been soaked to swell up were all transferred into a ball mill for ball milling for 30 min. The powder was then transferred into a conical vessel for rinsing with water for about 10 min until pH of the overflow water stabilized basically at 8. The alloy powders accumulated at the bottom of the conical vessel. The vessel was refilled with an acetylacetone aqueous solution (0.5 vol %) of pH 10, whereby the chemical rinsing was effected for 30 min under nitrogen with vigorous agitation. After that the chemical rinsing liquor was drained off and powders were again washed with water until the pH of overflow water stabilized at 8 again. Water was drained from the conical vessel and a desired amount of ethane was fed to soak the alloy powders for 30 min. Ethanol was drained and acetone was fed to soak for additional 30 min. And then acetone was drained and ether was fed to soak for 10 min. After ether had been drained, the alloy powders were removed and dried for 1 hr under vacuum at 120° C. The alloy composition was $Nd_{17.9}Fe_{74.0}B_{8.1}$, the purity 99.54% and calcium content 0.03%. The alloy was milled until an average diameter of about 3 $\mu$m was reached. The alloy powders were then compacted and shaped up under a pressure of 2 tons per square centimeter in a magnetic field of 10 kOe and sintered at 1000° C. under argon for 1 hr, then annealed (aged) at 600° C. for 1 hr. The cooled alloy was measured as maximum energy product $(BH)_{max}$=256.9 kJ/m$^3$, remanence Br=11.51 kG, coercive force iHc=802.0 kA/m.

Example 3

220 g $NdCl_3.6H_2O$ and 28 g of $DyCl_3.6H_2O$ were weighed and dissolved in 5 L of water, into which 4 ml of 1:1 hydrochloric acid was added, the solution was then gently warmed to give a pale purple clean solution. Then 700 g of $FeCl_2.4H_2O$ were weighed, added into the above solution and dissolved, thus a feed solution was prepared. 550 g of boric acid were weighed and dissolved in 5 L of water, into which 150 ml of concentrated ammonia water and 1000 g of ammonium carbonate were added and dissolved to form a clear solution as the precipitant. The precipitant solution was transferred into a 20 L reactor and heated to 50–60° C., into which the feed solution was slowly fed within 30 min with constant stirring (1500–2000 rpm). The precipitate was formed and gradually turned to dark green colour with pH of the mother liquor being 7.8. The solution was allowed to stand overnight for aging, then filtered, washed with water 5 times and dried to obtain 428 g of co-precipitate. The composition of alloy elements in the co-precipitate was $Nd_{14.2}Dy1.6Fe_{75.7}B_{8.5}$ and the alloy element content was 64.80%. The recovery rates of neodymium, dysprosium, iron and boron were 96.9%, 89.7%, 90.3% and 3.9%, respectively.

Example 4

The co-precipitate obtained from Example 3 was dried, ground, sieved through 100-mesh screen, and then subjected to a hydrogen pre-reduction in a similar method as described in Example 2. The product of pre-reduction was ground, rinsed with water and dried to obtain 320 g of black powder with an alloy element content being 87.6%. The powder was then ground and sieved through 180-mesh screen, then mixed with 160 g of calcium scraps (about 60% in excess). The mixture was tightly packed in an iron reaction can, which was then sealed and placed in the constant temperature zone of a tubular furnace. The reduction-diffusion was then effected by the same steps as in Example 2. The product was cooled and withdrawn from the reaction can, and then rinsed and dried by the same method as in Example 2. The alloy composition was $Nd_{14.0}Dy_{1.6}Fe_{76.5}B_{7.9}$, purity 99.61% and calcium content 0.04%. The resulting alloy was milled until an average diameter of about 3 $\mu$m was reached, and then oriented, compacted, sintered and aged under the same conditions as in Example 2. The cooled product was measured as maximum energy product $(BH)_{max}$=250.4 kJ/m$^3$, remanence Br=11.00 kG, and coercive force iHc=1402.4 kA/m.

Example 5

250 g of $NdCl_3.6H_2O$, 550 g of $FeCl_2.4H_2O$, 200 g of $CoCl_3.6H_2O$ and 20 g of $AlCl_3$ were weighed and dissolved in 5 L of water together, then 4 ml of 1:1 hydrochloric acid were added and the content was gently warmed for dissolution to give a red clear solution (feed solution). 310 g of boron oxide were weighed and dissolved in 5 L of water, then 150 ml of concentrated ammonia water and 1000 g of ammonium carbonate were added and dissolved to yield a clear solution (precipitant). The precipitant solution was transferred into a 20 L reactor and heated to 50–60° C. Then the feed solution was gradually fed within about 30 min with constant stirring (1500–2000 rpm), the pH of mother liquor being 8.0. The mixture was set aside overnight for aging, and then filtered, washed with water 5 times and dried to obtain 424 g of co-precipitate. The composition of alloy elements in the co-precipitate was $Nd_{15.4}Fe_{58.3}Co_{16.2}B_{8.2}Al_{1.9}$ and the content of alloy elements was 65.10%. The recovery rates of neodymium, iron, cobalt, boron and aluminum were 93%, 89.0%, 80.6%, 3.8% and 53.4%, respectively. After that the product was subjected to a hydrogen pre-reduction and dried by the same method as in Example 2. 318 g of black powder were thus obtained with alloy element content being 87.8%. The product was ground, sieved through 180-mesh screen, and then mixed with 100 g of calcium scraps and 80 g of calcium hydride. The mixture was then intimately packed in an iron reaction can, which was then sealed and placed in the constant temperature zone of a tubular furnace to allow the content to undergo a reduction-diffusion by the same steps as in Example 2. The cooled product was withdrawn from the reaction can, and then rinsed and dried by the same method as in Example 2. The alloy composition was $Nd_{15.2}Fe_{59.3}Co_{16.4}B_{7.5}Al_{1.6}$, purity 99.48% and calcium content 0.02%. The resulting alloy was milled until an average diameter of about 3 μm was reached, and then oriented, compacted, sintered and aged under the same conditions as in Example 2. The cooled product was measured as maximum energy product $(BH)_{max}$=328.3 kJ/m$^3$, remanence Br=13.4 kG, and coercive force iHc=814.5 kA/m.

Example 6

170 g of $NdCl_3.6H_2O$, 700 g of $FeCl_2.4H_2O$, 55 g of $CeCl_3.6H_2O$ and 30 g of $PrCl_3.6H_2O$ were weighed and dissolved in 5 L of water together, then 4 ml of 1:1 hydrochloric acid was added and the content was slightly warmed for dissolution to give a pale red clear solution (feed solution). 310 g of boron oxide were weighed and dissolved in 5 L of water, then 150 ml of concentrated ammonia water and 1000 g of ammonium carbonate were dissolved in it to form a clear solution (precipitant). The precipitant solution was transferred into a 20 L reactor and heated to 50–60° C. Then the feed solution was gradually fed within about 30 min with constant agitation (1500–2000 rpm), the pH of mother liquor being 8.2. The mixture was set aside overnight for aging, and then filtered, washed with water 5 times and dried to obtain 426 g of co-precipitate. The composition of alloy elements in the co-precipitate was $Nd_{10.9}Fe_{76.5}Ce_{3.2}B_{7.5}Pr_{1.9}$ and the content of alloy elements was 65.35%. The recovery rates of neodymium, praseodymium, cerium, iron, and boron were 96.6%, 93.50%, 90.1%, 91.1% and 3.5%, respectively. The product was hydrogen-pre-reduced and dried by the same method as in Example 2. 318 g of black powder were thus obtained with alloy element content being 87.5%. The product was ground, sieved through 180-mesh screen, and then mixed with 180 g of calcium scraps (about 60% in excess). The mixture was then intimately packed in an iron reaction can, which was then sealed and placed in the constant temperature zone of a tubular furnace to allow the content to undergo a reduction-diffusion by the same steps as in Example 2. The cooled product was withdrawn from the reaction can, and then rinsed and dried by the same method as in Example 2. The alloy composition was $Nd_{10.6}Fe_{76.6}Ce_{3.3}B_{7.3}Pr_{2.2}$, purity 99.61% and calcium content 0.03%. The resulting alloy was milled until an average diameter of about 3 μm was reached, and then oriented, compacted, sintered and aged under the same conditions as in Example 2. The cooled product was measured as maximum energy product $(BH)_{max}$=230.8 kJ/m$^3$, remanence Br=11.80 kG, and coercive force iHc=577.2 kA/m.

Example 7

200 g of $NdCl_3.6H_2O$, 50 g of $DyCl_3.6H_2O$, 680 g of $FeCl_2.4H_2O$ and 15 g of $AlCl_3$ were weighed and dissolved in 5 L of water together, then 4 ml of 1:1 hydrochloric acid were added and the content was slightly warmed for dissolution to give a pale red clear solution (feed solution I). 21.5 g of $NbOCl_3$ were weighed and dissolved in 100 ml of 1:1 hydrochloric acid (feed solution II). 300 g of boron oxide were weighed and dissolved in 5 L of water, then 150 ml of concentrated ammonia water and 1050 g of ammonium carbonate were dissolved in it to yield a clear solution (precipitant). The precipitant solution was transferred into a 20 L reactor and heated to 50–60° c. Then the feed solutions I and II were fed in a simultaneously-adding fashion into the precipitant solution within about 30 min with constant stirring (1500 rpm), pH of the mother liquor being 8.0 at the end of addition. The mixture was set aside overnight for aging, and then filtered, washed with water 5 times and dried to obtain 436.5 g of co-precipitate. The composition of alloy elements in the co-precipitate was $Nd_{12.4}Dy_{3.0}Fe_{74.2}Nb_{2.3}B_{6.8}Al_{1.3}$ and the content of alloy elements was 66.12%. The recovery rates of neodymium, dysprosium, iron, niobium, boron and aluminum were 95.6%, 96.4%, 92.9%, 99.4%, 3.4% and 49.5%, respectively. The product was hydrogen-pre-reduced and dried by the same method as in Example 2. 327 g of black powder were thus obtained with alloy element content being 88.2%. The product was ground, sieved through 180-mesh screen, and then mixed with 180 g of calcium scraps in a V-type mixer. The mixture was then intimately packed in an iron reaction can, which was then sealed and placed in the constant temperature zone of a tubular furnace to allow the content to undergo a reduction-diffusion by the same steps as in Example 2. The cooled product was withdrawn from the reaction can, and then rinsed and dried by the same method as in Example 2. The alloy composition was $Nd_{12.3}Dy_{3.0}Fe_{74.3}Nb_{2.6}B_{6.7}Al_{1.1}$, purity 99.47% and calcium content 0.01%. The resulting alloy was milled until an average diameter of about 3 μm was reached, and then oriented, compacted, sintered and aged under the same conditions as in Example 2. The cooled product was measured as maximum energy product $(BH)_{max}$=240 kJ/m$^3$, remanence Br=11.00 kG, and coercive force iHc=1354 kA/m.

Example 8

200 g of $NdCl_3.6H_2O$, 55 g of $DyCl_3.6H_2O$, 680 g of $FeCl_2.4H_2O$ and 50 g of $CuCl_2.4H_2O$ were weighed and dissolved in 5 L of water together, then 2 ml of 1:1 hydrochloric acid were added and the content was slightly warmed for dissolution to give a pale red clear solution (feed solution). 350 g of boron oxide were weighed and dissolved in 5 L of water, then 100 ml of concentrated ammonia water and 1100 g of ammonium carbonate were dissolved in it to yield a clear solution (precipitant). The precipitant solution was transferred into a 20 L reactor and heated to 60° C. Then the feed solution was gradually fed within about 30 min with constant stirring (2000 rpm), the pH of mother liquor being 7.6. The mixture was allowed to stand overnight for aging, and then filtered, washed with water 5 times and dried to obtain 437 g of co-precipitate. The composition of alloy elements in the co-precipitate was $Nd_{12.4}Dy_{3.2}Fe_{75.2}B_{6.2}Cu_{3.0}$ and the content of alloy elements was 65.86%. The recovery rates of neodymium, dysprosium, iron, copper and boron were 95.0%, 93.5%, 93.6%, 43.3% and 2.6% respectively. The product was hydrogen-pre-reduced and dried by the same method as in Example 2. 328 g of black powder were thus obtained with alloy element content being 87.9%. The product was ground, sieved through 180-mesh screen, and then mixed with 160 g of calcium scraps. The mixture was then intimately packed in an iron reaction can, which was then sealed and placed in the constant temperature zone of a tubular furnace to allow the content to undergo a reduction-diffusion by the same steps as in Example 2. The cooled product was withdrawn from the reaction can, and then rinsed and dried by the same method as in Example 2. The alloy composition was $Nd_{2.2}Dy_{3.3}Fe_{75.2}B_{6.0}Cu_{3.3}$, purity 99.66% and calcium content 0.04%. The resulting alloy was milled until an average diameter of about 3 μm was reached, and then oriented, compacted, sintered and aged under the same conditions as in Example 2. The cooled product was measured as maximum energy product $(BH)_{max}$=254.8 kJ/m$^3$, remanence Br=11.54 kG, and coercive force iHc=813 kA/m.

Example 9

250 g of machining surplus of composition $Nd_{15.4}Fe_{76.4}B_{8.2}$ were weighed and dissolved in 2500 ml of 1:1 hydrochloric acid, into which 50 g of $FeCl_2.4H_2O$ were added, then the mixture was slightly warmed for dissolution to become a clear solution and diluted to 5 L (feed solution). 500 g of boric acid were weighed and dissolved in 5 L of water, then 200 ml of concentrated ammonia water and 1000 g of ammonium carbonate were dissolved in it to give a clear solution (precipitant). The precipitant solution was transferred into a 20 L reactor and heated to 50–60° C. Then the feed solution was gradually fed within about 30 min with constant stirring (1500–2000 rpm). The precipitate was formed and slowly turned to dark green colour with pH of the mother liquor being 7.5. the mixture was set aside overnight for aging, and then filtered, washed with water 5 times and dried to obtain 389 g of co-precipitate. The composition of alloy elements in the co-precipitate was $Nd_{15.2}Fe_{76.3}B_{8.5}$ and the content of alloy elements was 65.35%. The recovery rates of neodymium, iron and boron were 93.0%, 86.7% and 33%, respectively. The product was hydrogen-pre-reduced and dried by the same method as in Example 2. 290 g of black powder were thus obtained with alloy element content being 88.0%. The product was ground, sieved through 180-mesh screen, and then mixed with 130 g of calcium scraps (about 50% in excess). The mixture was then intimately packed in an iron reaction can, which was then sealed and placed in the constant temperature zone of a tubular furnace to allow the content to undergo a reduction-diffusion by the same steps as in Example 2. The cooled product was withdrawn from the reaction can, and then rinsed and dried by the same method as in Example 2. The alloy composition was $Nd_{15.2}Fe_{76.8}B_{8.0}$, purity 99.42% and calcium content 0.04%. The resulting alloy was milled until an average diameter of about 3 $\mu$m was reached, and then oriented, compacted, sintered and aged under the same conditions as in Example 2. The cooled product was measured as maximum energy product $(BH)_{max}$=254.8 kJ/m$^3$, remanence Br=11.20 kG, and coercive force iHc=810.4 kA/m.

What is claimed is:

1. A process for the preparation of Nd—Fe—B permanent magnetic alloys, comprising the steps of:

(a) mixing an aqueous solution of a neodymium salt with an aqueous solution of a ferrous salt to yield a feed solution;

(b) mixing the feed solution with a precipitant to form a co-precipitate product, wherein the precipitant comprises aqueous ammonium hydroxide, aqueous ammonium carbonate and a soluble boron compound;

(c) removing oxygen from the co-precipitate product by introducing a hydrogen stream to the co-precipitate product and removing an effluent therefrom, wherein the hydrogen stream is introduced until there is no moisture in the effluent and only oxygen is left over in the product apart from the alloy elements, thereby forming a hydrogen pre-reduction product;

(d) intimately mixing the hydrogen pre-reduction product with at least one of metallic calcium and calcium hydride, thereby forming a calcium reduction-diffusion product;

(e) rinsing and drying the calcium reduction-diffusion product; and (f) manufacturing an alloy powder from the calcium reduction-diffusion product.

2. The process of claim 1, wherein the weight ratio of neodymium in the neodymium salt to iron in the ferrous salt to boron in the soluble boron compound is 1:1.0–2.5:10–100; and wherein the amount of the precipitant is 1.5–5 times the stoichiometric quantity; and wherein the mole ratio of ammonium hydroxide to ammonium carbonate is 1:1.5–7; and wherein the molar amount of the at least one of metallic calcium and calcium hydride is 1.4–4.0 times the stoichiometric quantity.

3. The process of claim 2, wherein the mole ratio of ammonium hydroxide to ammonium carbonate is 1:3–5.

4. The process of claim 1, wherein said neodymium salt in step (a) is selected from the group consisting of neodymium chloride, neodymium nitrate, neodymium sulfate and neodymium oxide which is soluble in hydrochloric acid; said ferrous salt is selected from the group consisting of ferrous chloride and ferrous sulfate; and wherein said boron compound in step (b) is selected from the group consisting of boric acid, borax and boron oxide.

5. The process of claim 1, wherein step (b) takes place at a temperature of 50–60° C.

6. The process of claim 1, wherein said feed solution in step (a) is partially prepared by dissolving waste or machining surplus of Nd—Fe—B permanent magnetic alloys in hydrochloric acid.

7. The process of claim 1, wherein light rare earths or heavy rare earths are used in addition to neodymium, and wherein aluminum is used in addition to boron, and wherein transition metals are used in addition to iron, to prepare permanent magnetic alloys with an improved or modified magnetism.

8. The process of claim 7, wherein the light rare earths are of a material selected from the group consisting of lanthanum, cesium, praseodymium and combinations thereof.

9. The process of claim 7, wherein the heavy rare earths are of a material selected from the group consisting of terbium, dysprosium, holmium and combinations thereof.

10. The process of claim 7, wherein the transition metals are of a material selected from the group consisting of cobalt, nickel, copper, niobium and combinations thereof.

11. The process of claim 7, wherein the ratio of the weight of the neodymium in the neodymium salt, the light rare earths and the heavy rare earths to the weight of the iron in the ferrous salt and the transition metals to the weight of the boron in the soluble boron compound and the aluminum is 1:1.0–2.5:10–100.

12. The process of claim 1, wherein the mixture of feed solution and precipitant of step (b) is maintained at a temperature in the range from 40–80° C., and wherein the mixture is constantly stirred, and wherein the mixture is maintained at a pH in the range from 7–10, and further comprising the steps of setting the mixture aside for 12–48 hours after complete reaction, washing the co-precipitate product with water 3–6 times and drying the co-precipitate product.

13. The process of claim 1, further comprising the steps of grinding the co-precipitate product, sieving the co-precipitate product through 80-mesh to 180-mesh screens and introducing a nitrogen stream to the co-precipitate product at a temperature of 600–1000° C. in a rotary drying furnace, until no ammonia is present in an effluent removed therefrom.

14. The process of claim 1, further comprising the steps of cooling the hydrogen pre-reduction product, sieving the hydrogen pre-reduction product through 80-mesh to 180-mesh screens, rinsing the hydrogen pre-reduction product with water in a conical rinser until no white waxy particles overflow and drying the hydrogen pre-reduction product.

15. The process of claim 1, further comprising the steps of drying the hydrogen pre-reduction product in a rotary drying furnace at a temperature of 120° C. and a pressure of 1–5 Pa, cooling the hydrogen pre-reduction product, grinding the hydrogen-pre-reduction product and sieving the hydrogen-pre-reduction product through 80-mesh to 180-mesh screens.

16. The process of claim 1, wherein the step of mixing the hydrogen pre-reduction product of step (d) proceeds in a sealed reaction can under an atmosphere of inert gas, reducing gas or a pressure of 1–5 Pa, and wherein the mixture is heated to 1000–1250° C. for 1–3 hours, and wherein the calcium reduction-diffusion product is rapidly cooled to room temperature.

17. The process of claim 1, wherein the step of rinsing the calcium reduction-diffusion product comprises the steps of soaking the product with water, milling the product to 10–50 $\mu$m, rinsing the product with water under an inert gas in a conical rinser until the pH of waste water flowing therefrom is 8, rinsing the product with a chemical rinsing liquid under intensive agitation, rinsing the product with water until the pH of waste water flowing therefrom is 8, and soaking the product with ethanol, acetone and ether successively, each for 10–30 minutes.

18. The process of claim 17, wherein said chemical rinsing liquid comprises 0.5–3 wt % EDTA or 0.5–1 vol % acetylacetone aqueous solution with pH 8–10.

19. The process of claim 1, wherein the step of drying the calcium reduction-diffusion product proceeds at a temperature of 120° C. and at a pressure of 1–5 Pa for 1 hour.

20. The process of claim 1, wherein the step of manufacturing an alloy powder comprises milling the calcium reduction-diffusion product, and wherein the alloy powder has an average diameter of 3 $\mu$m.

21. The process of claim 1, wherein the step of mixing the feed solution with a precipitant comprises adding the precipitant into the feed solution.

22. The process of claim 1, wherein the step of mixing the feed solution with a precipitant comprises adding the feed solution into the precipitant.

23. The process of claim 1, wherein the step of mixing the feed solution with a precipitant comprises adding the feed solution and the precipitant simultaneously into a reactor at desired flow rates.

* * * * *